United States Patent [19]

Nystrom

[11] Patent Number: 5,033,956

[45] Date of Patent: Jul. 23, 1991

[54] SYSTEM FOR AND METHOD OF CONTROLLING FUEL FLOW TO A HEATING DEVICE

[75] Inventor: Thomas L. Nystrom, Monkton, Md.

[73] Assignee: Teledyne Isotopes, Inc., Westwood, N.J.

[21] Appl. No.: 454,315

[22] Filed: Dec. 26, 1989

[51] Int. Cl.[5] ..... F23D 5/00

[52] U.S. Cl. ..... 431/11; 431/333; 126/93; 126/110 B

[58] Field of Search ..... 431/11, 12, 206, 207, 431/208, 215, 218, 243, 262, 258, 333, 331; 126/110 B, 93; 219/202; 237/123 A

[56] References Cited

U.S. PATENT DOCUMENTS

| | | |
|---|---|---|
| 2,527,921 | 10/1950 | Every . |
| 2,548,830 | 4/1951 | Thomas et al. . |
| 3,106,956 | 10/1963 | Smith et al. . |
| 3,152,634 | 10/1964 | Schotsman . |
| 3,632,284 | 1/1972 | Reichhelm . |
| 4,193,755 | 3/1980 | Guarnaschelli et al. . |
| 4,843,273 | 6/1989 | Dammers et al. . |

·OTHER PUBLICATIONS

Carmine Luciani & Thomas L. Nystrom, A Thermoelectric Heater for Low Temperature Operation of Military Vehicles, Sep. 1980, Controls International B.V. Brochure (Undated).

*Primary Examiner*—Larry Jones

*Attorney, Agent, or Firm*—Fleit, Jacobson, Cohn, Price, Holman & Stern

[57] ABSTRACT

Flow of liquid fuel to a vaporization tube of a heating device is controlled by a vertically adjustable float valve, with the vertical height of a surface level of the fuel in a float valve chamber being set to correspond to a desired operating level of the liquid fuel in the vaporization tube. Liquid fuel is permitted to free-flow from the float valve chamber to the lower end of the vertical vaporization tube without metering, the rate of flow and the level of the fuel in the vaporization tube being determined solely by the hydraulic head created by the surface level of the fuel in the float valve chamber. Raising of the float valve chamber produces a corresponding raising of the level of the fuel in the vaporization tube to increase the tube inner surface area which is contacted or wetted by the fuel in the tube, thus causing an increase in the rate of vaporization and a corresponding increase in heat output of the heating device. Conversely, lowering of the float valve chamber causes a corresponding lowering of the level of the fuel in the vaporization tube, with a consequent reduction in the vaporization rate and the heat output of the heating device. The fuel control system and method is disclosed in combination with a vaporization-type heating device comprising a thermoelectric converter.

18 Claims, 4 Drawing Sheets

SYSTEM FOR AND METHOD OF CONTROLLING FUEL FLOW TO A HEATING DEVICE

BACKGROUND OF THE INVENTION

1. Field of the Invention

This invention relates to a system for and method of controlling fuel flow to a heating device, and more particularly to a system for and method of controlling fuel flow to a vertical vapor generator or vaporization tube located in a combustion chamber of a heating device of a self-generating type in a stable, readily changeable and predictable manner.

2. Description of the Prior Art

Self-generating heating devices are known in which liquid fuel is fed from a fuel supply tank to a vertical vapor generator or vaporization tube in which the liquid fuel is heated and converted to a vapor state using heat from the combustion process. The resultant fuel vapor proceeds upward through the vertical vaporization tube and then into a downwardly extending vertical vapor-conducting "down" tube from which it feeds and mixes with air in a combustion chamber of the heating device. Thus, after initial ignition in the combustion chamber, the heating device heats the vaporization tube externally to generate its own fuel vapor for continued combustion in a self-generating manner.

Typically, in feeding of the liquid fuel to the vertical vaporization tube, fuel initially flows from the supply tank by gravity to a float valve comprising an inlet valve and a float member. The liquid fuel flows through the inlet valve into the float valve under the control of the float member, with the float member closing the inlet valve when a float chamber becomes filled to a desired level, and opening the inlet valve to maintain the desired fuel level as the liquid fuel feeds out of the float chamber. The float valve is mounted in a fixed position in which the fuel level in the float valve is just below the level of an elbow-type connector member which connects the vertical vaporization tube to the vapor-conducting down tube adjacent the upper end of the vaporization tube.

Flow of the liquid fuel from the float valve is controlled by adjusting a relatively small variable opening or orifice in a metering valve, as for example, by a rotatable spool or a vertical metering stem. However, if the liquid fuel is changed from one type of fuel, having a relatively low viscosity, such as gasoline, to a fuel having a higher viscosity, such as diesel fuel, the fuel flow through the metering valve will be less for a given setting and temperature, requiring a change in the setting of the metering valve control orifice for delivery of the same amount of fuel. Similarly, changes in temperature also require different fuel flow settings of the fuel metering valve control orifice, and foreign particles or sediment in the fuel can adversely affect the rate of fuel flow through the small metering valve control orifice. The required manual adjustment of the metering valve control orifice also can be objectionable in certain applications because of the time involved to achieve an appropriate setting.

Further, in many heating device applications, it is desirable, and in some instances essential, that the fuel flow rate be controlled within a narrow range despite variables, such as the abovementioned viscosity and temperature. For example, a heating device that comprises a thermoelectric converter for converting heat energy into electrical energy, is such an application. In this type of heating device, the power produced by the thermoelectric converter is proportional to the fuel flow rate, and to obtain best performance from the thermoelectric converter, its hot junction electrode temperature should be as high as possible. Thus, if the fuel flow rate varies across too broad a range, as is generally the case in control systems using an orifice-varying metering system as above described, either the temperature at the hot junction electrode or electrodes of the thermoelectric converter is not high enough and the power produced by the thermoelectric converter may be too low, or the thermoelectric materials of the thermoelectric converter may be damaged by overheating.

In addition to a fuel flow control system as above described, other fuel flow control systems also are known in the art. For example, U.S. Pat. No. 2,527,921 to W. W. Every discloses a vertically adjustable float valve for varying fuel flow to an oil burner, and U.S. Pat. No. 2,548,830 to C. P. Thomas et al discloses a stove having a vertically adjustable vaporizing pot-type burner-and-control unit, with the control unit including a float valve and a stem-type metering valve. Further, examples of known heaters which employ thermoelectric converters include that disclosed in a paper No. 13 entitled "A Thermoelectric Heater for Low Temperature Operation of Military Vehicles", presented by Carmine Luciani and Thomas L. Nystrom at the International Power Source Symposium in Brighton, England, in September 1980. Another heater of this type is that disclosed in U.S. Pat. No. 4,843,273, issued June 27, 1989, to H. Dammers et al, and entitled "Heater Mechanism with Thermoelectric Power Generator".

Accordingly, a primary purpose of this invention is to provide a fuel flow control system and method in which the rate of liquid fuel flow to a vertical vaporization tube, and consumption of fuel in an associated combustion chamber of a heating device, is controlled directly by a vertically adjustable float valve without the need for a metering orifice-type valve, whereby the fuel flow rate is stable, readily changeable and predictable, despite variable parameters, such as viscosity and temperature, and the presence of foreign particles or sediment in the fuel.

SUMMARY OF THE INVENTION

In general, this invention relates to the controlling of fuel flow to a vertically extending fuel vaporization mechanism, such as a vertical vaporization tube, for producing fuel vapor from the liquid fuel and supplying the fuel vapor to a combustion chamber of a heating device. For this purpose, a liquid fuel chamber, for supplying the liquid fuel to the vertical vaporization tube, is provided with at least a portion of the chamber disposed between vertical levels corresponding to vertical levels of the tube. A float mechanism in the liquid fuel chamber establishes an upper surface level of the liquid fuel and a corresponding liquid fuel hydraulic head in the chamber, and the liquid fuel then freeflows from the chamber to the vertical vaporization tube essentially only in response to the hydraulic head, to produce a desired uniform fuel flow rate to the tube.

More specifically, the liquid fuel supply chamber is vertically adjustable to vary the vertical position of the upper surface level of the liquid fuel in the supply chamber, and thereby change the liquid fuel hydraulic head exerted from the chamber on the liquid fuel in the vertical vaporization tube a corresponding amount, to vary the fuel flow rate to the tube. As a result, the internal surface area of the vertical vaporization tube wetted by the liquid fuel is increased or decreased a corresponding amount, to increase or decrease the rate of vaporization of the liquid fuel in the vaporization tube, respectively, thus increasing or decreasing the thermal output of the heating device. Further, the vaporization tube is located in the combustion chamber and vaporization of the liquid fuel in the tube is accomplished by applying heat externally to the tube from the combustion chamber, so that the heating device is self-generating. The fuel flow control system also may be utilized in combination with a thermoelectric converter in which a hot junction electrode of the converter is heated by heat from the heating device combustion chamber, and a cold junction electrode of the converter is cooled by the same device which supplies ambient air flow to the heating device combustion chamber for the combustion process, with the electrical power output of the converter being used to power the flow-producing device, thus making the heating device further self-generating.

DETAILED DESCRIPTION OF THE DRAWINGS

Figure 1:
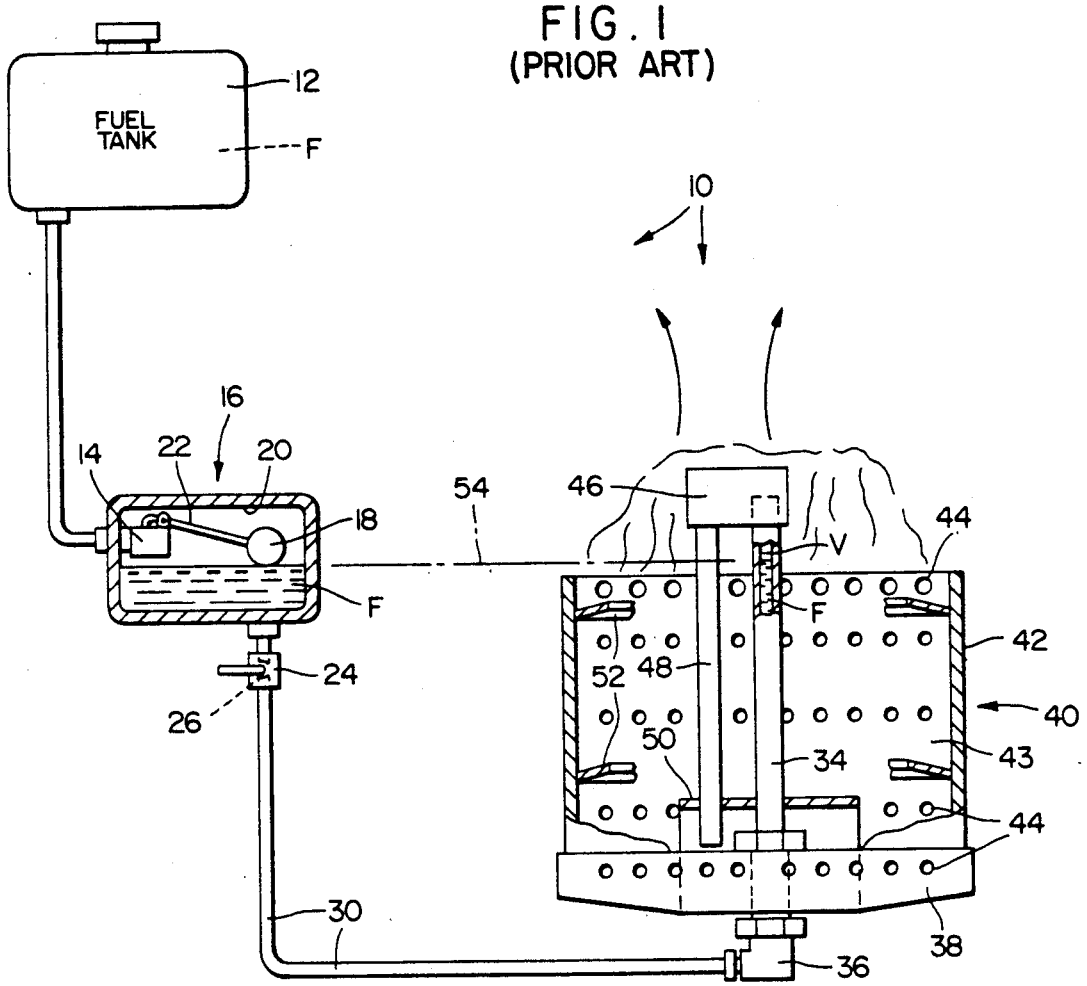
FIG. 1 (PRIOR ART)
FIG. 1 is a schematic view of a known prior art system, partially in cross section, for controlling the flow of liquid fuel to a vertical vaporization tube of a heating device, also of a known type, with certain parts of the heating device omitted.

Referring to FIG. 1 of the drawings, there is illustrated schematically a prior known self-generating or self-operating, vaporization-type heating device 10 in which liquid fuel F flows from a fuel supply tank 12 by gravity to an inlet valve 14 of a float valve 16. The float valve 16 includes a float member 18 supported in a valve chamber 20 on one end of a lever member 22 pivotably mounted, for example, on the inlet valve 14, and having an opposite end engaged with a valve closing-and-opening mechanism (not shown) to close the inlet valve when the fuel level in the float valve chamber rises to a certain level, and to open the valve when the fuel level in the float valve chamber drops below that level.

The liquid fuel F flows out of the float valve 16 by gravity through a metering valve 24 adjacent the bottom of the float valve, with the amount of fuel which flows through the metering valve being controlled by adjusting the valve to vary the size of a metering opening or orifice 26 in the metering valve. By way of example, the metering valve 24 may be of a rotatable spool type, as shown in FIG. 1, or may have an orifice the size of which is varied by a handle-operated vertical stem, not shown. The liquid fuel F then flows, via a line 30, to a vertical vapor generator or vaporization tube 34 by way of a coupler 36 on a base member 38 of a burner 40 of the vaporization-type heating device 10, the remainder of which is not shown.

The burner 40 of the fuel vaporization-type heating device 10 further comprises a cylindrical burner shell 42 which extends upward from the burner base member 38 and cooperates therewith to define a combustion chamber 43, with the base member and shell being provided with suitable air inlet holes 4 by which ambient air may be introduced into the combustion chamber. The upwardly extending vertical vaporization tube 34 has a lower end suitably connected to the coupler 36, and thus to the feed line 30, so that the liquid fuel F feeds upward into the tube. An upper end of the vaporization tube 34 is connected to an elbow-type connector member 46 also having a downwardly extending vertical vapor-conducting "down" tube 48 connected thereto. A lower end of the vapor-conducting down tube 48 terminates adjacent a heat-absorbing plate 50 known in the art as a "superheater", for re-vaporizing any fuel F which may have condensed during travel through the vapor-conducting tube. The interior of the burner shell 42 also includes a pair of vertically spaced annular ring members 52 known as "firing rings", between which partial combustion takes place, with combustion being completed above the burner shell.

In use, the orifice 26 of the metering valve 24 is opened and adjusted to produce a desired fuel flow rate. The combustion process then is initiated in the burner 40 in a known manner, such as by igniting a small quantity of a start-up fuel poured into the combustion chamber 43, with a match, lighted paper or an electrical ignitor. Subsequently, after an approximately 5-10 minute startup time, the heat of the combustion process which is being applied externally to the vaporization tube 34 causes vaporization of the liquid fuel F in the tube, with the resultant fuel vapor V feeding through the downwardly extending vertical vapor-conducting tube 48 to the lower end of the combustion chamber 43, whereupon the heating device 10 becomes self-generating. When it is desired to shut the heating device 10 off, the metering valve 24 is moved to a closed position, to preclude further fuel flow to the vaporization tube 34.

In the heating device 10 shown in FIG. 1, the liquid fuel F in the float valve 16 is maintained at a constant level which corresponds essentially to a maximum desired level of the fuel in the vertical vaporization tube 34, that is, a level slightly below the tube connector member 46, as illustrated by the broken line 54 in FIG. 1. The liquid fuel F in the float valve 16 then is metered through the metering valve orifice 26, and flows through the feed line 30 to the vertical vaporization tube 34, with the amount of fuel flow being controlled by the metering valve orifice. However, because of the small size of the metering valve orifice 26, whenever a fuel F of a different viscosity is used, or when the heating device 10 is to operate under different temperature conditions, it is necessary to adjust the metering valve orifice an appropriate amount by trial-and-error. Further, foreign deposits in the fuel F tend to clog the metering valve orifice 26 to reduce and/or cause a variation in the rate of fuel flow to the vertical vaporization tube 34, thereby causing an unstable and unpredictable heat energy output from the heating device 10.

Figure 2:
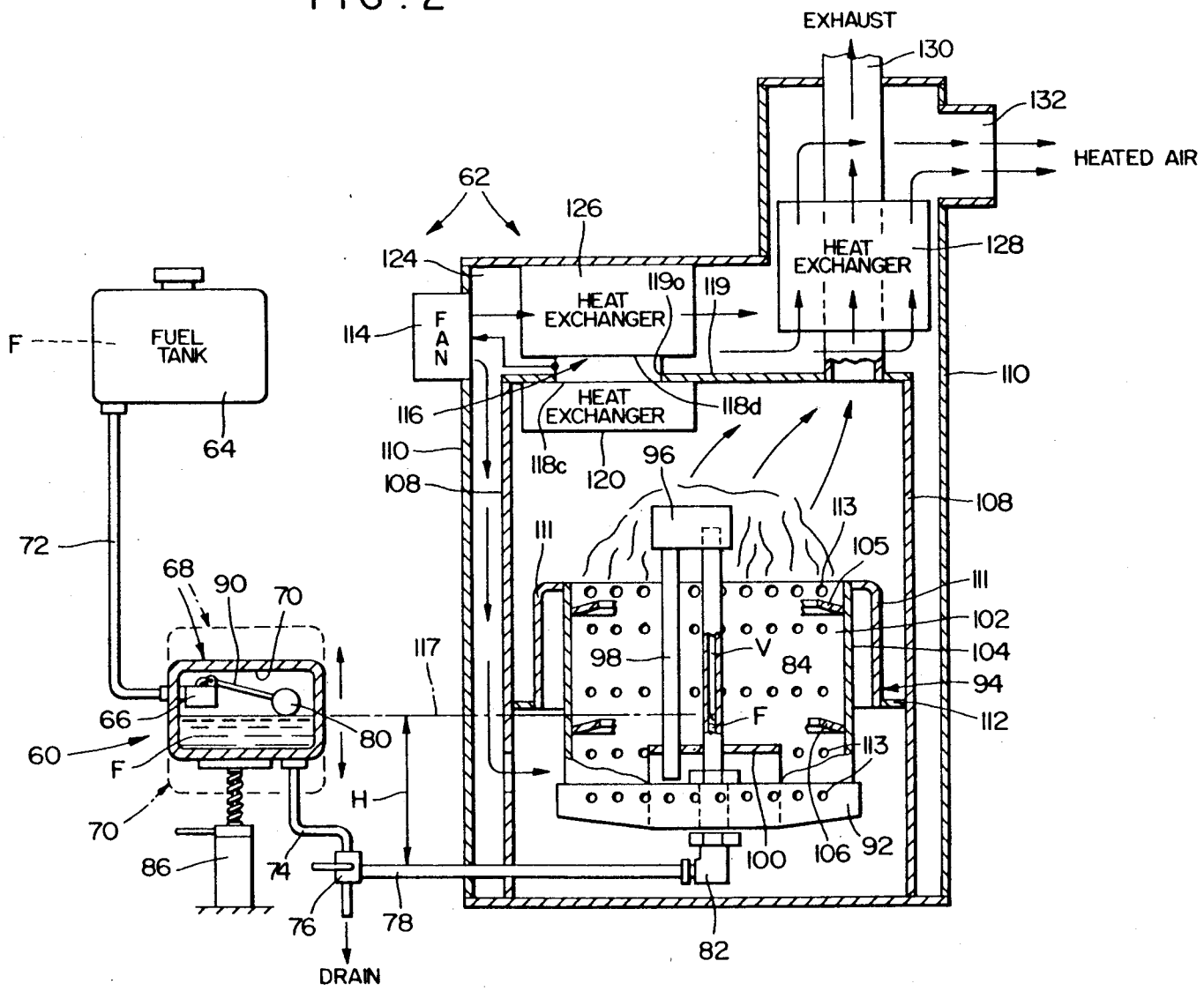
FIG. 2 is a schematic view of a system, partially in cross section, for controlling the flow of liquid fuel to a vertical vaporization tube of a heating device as shown in FIG. 1, in accordance with the invention, with the heating device also shown in combination with a thermoelectric converter module.

Referring to FIG. 2, in accordance with the subject invention, and in contrast to the constant fuel level-and-liquid fuel metering system shown in FIG. 1, a fuel-flow control system 60 of a free-flow type, responsive only to a hydraulic head H, is provided in a vaporization-type, self-generating heating device 62. In the fuel-flow control system 60, liquid fuel F feeds from a fuel tank 64 by gravity to an inlet valve 66 in a vertically adjustable float valve 68 having a float chamber 70, by a first flexible conduit line 72. Further, the metering valve 24 of FIG. 1 is eliminated, and the liquid fuel F free-flows without any significant obstruction or metering from the float valve chamber 70 directly through a second flexible conduit line 74 to a three-way valve 76, and then through a conduit line 78 to a coupler 82 and vertical vaporization tube 84 of the same construction as those shown in FIG. 1. Thus, the flexible lines 72 and 74 permit the float valve 68 to be raised or lowered, that is, adjusted vertically as desired to change the hydraulic head H which the float valve exerts on the liquid fuel F in the vertical vaporization tube 84, to raise and lower the level of the fuel in the tube. For this purpose, the float valve 68 is supported on a vertical adjustment mechanism, such as a screw-type jack 86, as illustrated in FIG. 2.

As in the device shown in FIG. 1, the float valve 68 includes a float member 80 mounted on a lever member 90 which, in turn, is pivotably mounted, as for example, on the inlet valve 66, for controlling flow of the liquid fuel F into the float chamber 70. In addition, the liquid fuel F flows from the three-way valve 76 to the coupler 82, which is mounted on a base member 92 of a burner 94, to the lower end of the vertical vaporization tube 84, as noted previously. Further, the upper end of the vertical vaporization tube 84 is connected to an elbow-type connector member 96, to which an upper end of a downwardly extending vertical vapor-conducting "down" tube 98 is mounted, with a lower end of the vapor-conducting tube extending adjacent a "superheater" plate 100 in a combustion chamber 102 defined by the burner base 92 and an upstanding cylindrical burner shell 104 which includes upper and lower firing rings 105 and 106, respectively. The burner 94 is mounted in a suitable heater box 108 which, in turn, is mounted in a housing 110, with the heater box and housing each having a suitable door, not shown. More specifically, the burner shell 104 has a depending air-collecting hood 111 of a known type mounted at its upper end, with a lower end of the hood fixedly mounted to a combination support-and-seal member in the form of a horizontally disposed "hangar" plate 112 having a central opening and fixedly secured around its periphery to the interior of the heater box 108.

The burner base 92 and shell 104 further include air inlet openings 113, through which, in accordance with the invention, combustion air is provided by a fan 114 located on a sidewall of the housing 110. In addition, the subject invention is shown in combination with a thermoelectric convertor module 116, which may be of a known type, mounted above the upper end of the burner shell 104.

In accordance with the subject invention, the level of the liquid fuel F in the float chamber 70, rather than being maintained at essentially the maximum desired fuel level in the vertical vaporization tube 84, preferably is set at an intermediate level which it has been found is the normal level which the fuel will assume in the tube in operation, such as ¼ inch to 1¼ inches above the superheater 100, as illustrated by the broken line 117 in FIG. 2. Then, because the fuel F free-flows (i.e., is not metered) from the float chamber 70 to the lower end of the vertical vaporization tube 84 in an unobstructed manner, the hydraulic head H created by the fuel level in the float chamber will maintain the fuel level in the vaporization tube constant despite changes in temperature and/or viscosity of the fuel, and or foreign particles or sediment therein, to provide a very precise control of the fuel flow rate to the tube.

Accordingly, where it is desired to increase or decrease the heat output of the heating device 62, it is only necessary to raise or lower the float chamber 70 an appropriate amount by the screw-jack 86, to increase or decrease the hydraulic head H created by the fuel level in the float chamber. Thus, if the float chamber 70 is raised to increase the hydraulic head H, the fuel level in the vaporization tube 84 is raised a corresponding amount, whereas if the float chamber is lowered, the fuel level in the vaporization tube is lowered a corresponding amount. As a result, since raising the fuel level in the vaporization tube 84 increases the tube inner surface-to-liquid fuel contact or "wetted" area in the tube, the rate of vaporization of the liquid fuel F in the tube from heat applied externally of the tube as a result of the combustion process, is increased, resulting in an increased rate of flow of vapor V into the combustion chamber 102, with a resultant increase in heat output of the heating device 62. Conversely, if the fuel level in the vaporization tube 84 is decreased, the tube inner surface-to-liquid fuel contact or "wetted" area is decreased, to cause a corresponding decrease in the rate of vaporization of the fuel F, with a corresponding decrease in the heat output of the heating device 62.

Figure 5:
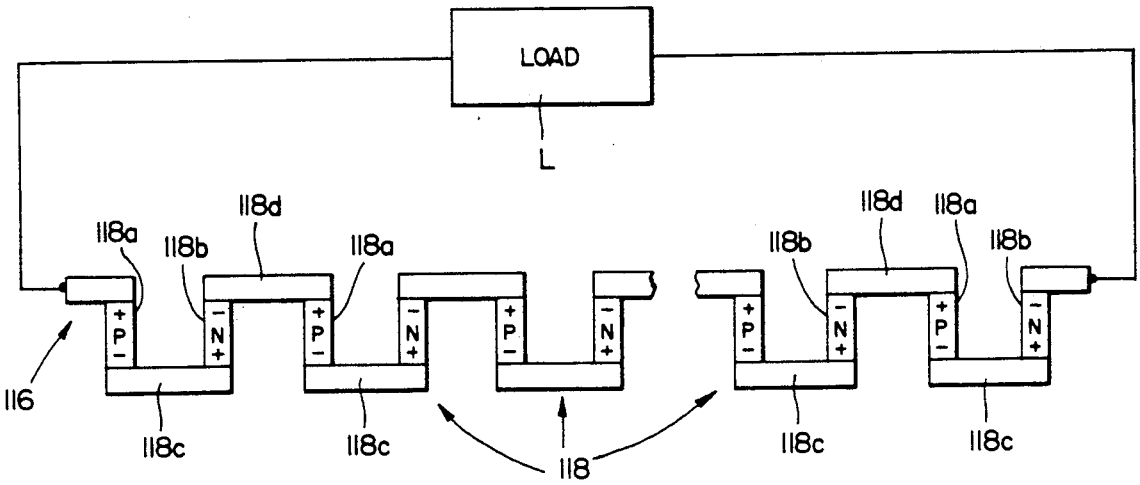
FIG. 5 (PRIOR ART)
FIG. 5 is a schematic diagram of a known prior art thermoelectric converter.

As is known in the art, a thermoelectric converter, such as the thermoelectric converter module 116, produces electrical power through the direct conversion of heat energy into electrical energy, utilizing a system of thermocouples 118, as is illustrated schematically in FIG. 5. In this regard, each thermocouple 118 consists of two legs **118*a* and 118*b* of dissimilar materials (i.e., P-type and N-type), which are joined together at one end by an electrical conductor 118*c*, known as a "hot junction electrode". Adjacent legs 118*a* and 118*b* of the thermocouples 118 are connected together at points spaced from respective ones of the hot junction electrodes 118*c*, by additional conductors 118*d*, to form respective "cold junction electrodes", with the thus-formed hot junction electrodes and cold junction electrodes arranged in a series relationship. If the hot junction electrodes 118*c* then are heated to a higher temperature than the cold junction electrodes 118*d*, a series of small voltages will exist across the cold junction electrodes and electrical power will be delivered to a load L (e.g., fan 114) connected across the outermost legs 118*a* and 118*b*** of the thus-defined series electrical circuit, provided that the temperature difference between the hot junction electrodes and the cold junction electrodes is maintained.

With further reference to FIG. 2, the thermoelectric converter module 116 is shown mounted in an opening **119*o* in an upper horizontal wall 119 of the heater box 108 so that the hot junction electrodes 116*c* (best shown in FIG. 5) of the thermoelectric converter module 116 are heated as a result of the combustion process in the burner combustion chamber 102, through a suitable first heat exchanger 120 (e.g., heat-conductive fins). At the same time, the cold junction electrodes 118***d* (best shown in FIG. 5) of the thermoelectric converter module 116 are located in a path of incoming ambient air flow being generated by the fan 114 through a conduit 124, to maintain the cold junction electrodes near ambient air temperature through a suitable second heat exchanger 126 (e.g., cooling fins). In this instance, the resultant electrical power generated by the thermoelectric converter module 116 then is used to operate the fan 114 to make the heating device 62 further self-operating. The ambient air used to cool the cold junction electrodes 118*d* then passes to a heat exchanger 128 surrounding a combustion exhaust stack 130 and ultimately passes through an exit conduit 132 into an area to be heated.

Figure 3:
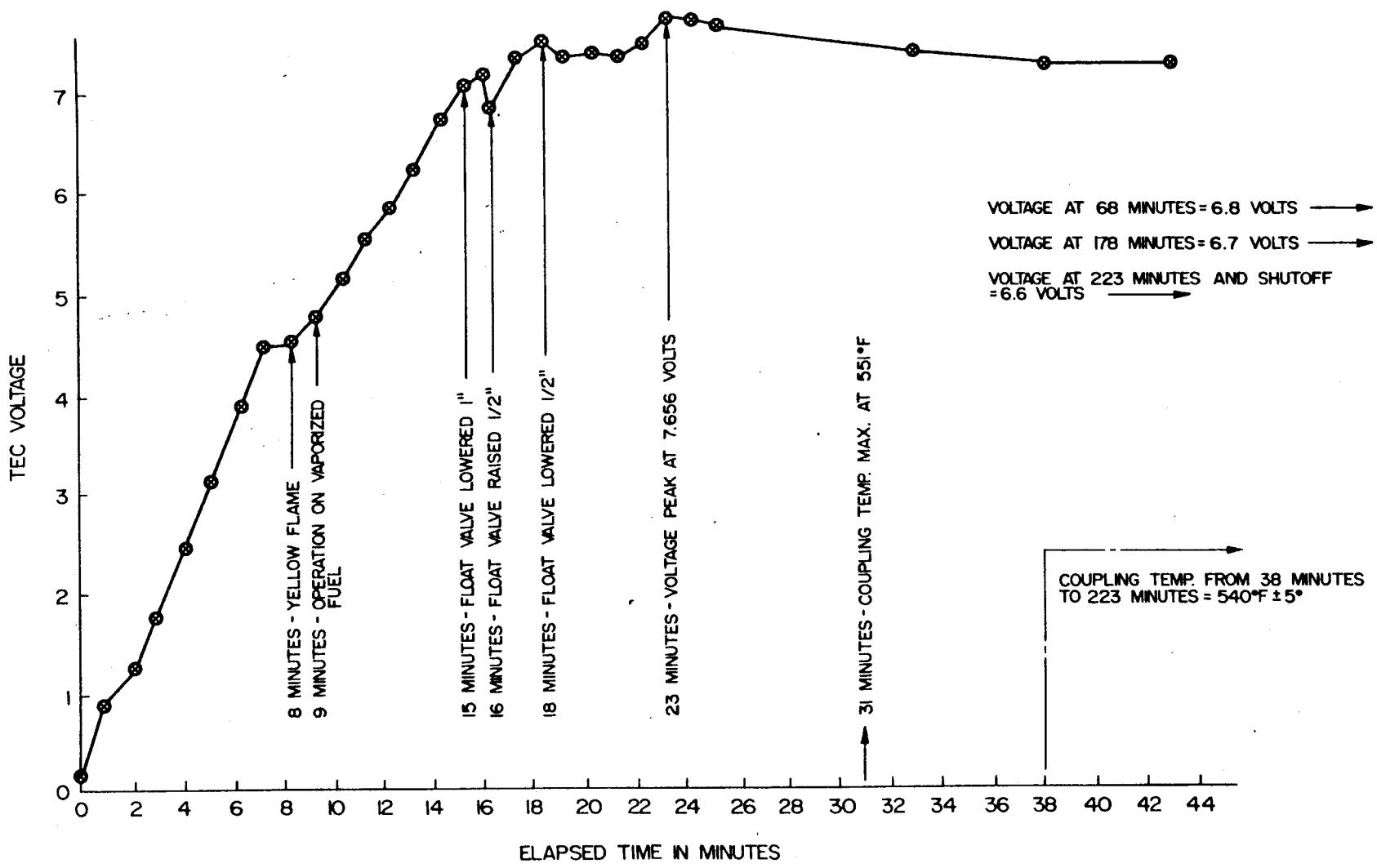
FIG. 3 is a graph illustrating response and uniformity characteristics of the liquid fuel flow control system of the invention, based on the voltage output of the thermoelectric converter module shown in FIG. 2, and fuel temperature.

The graph of FIG. 3 illustrates the rapid response and uniformity of fuel flow which can be achieved with the fuel flow control system 60 disclosed in FIG. 2 and above described, when used in conjunction with the thermoelectric converter module 116, based upon the output voltage of the thermoelectric converter module and temperature at the vaporization tube coupler 82. In this regard, in the test run illustrated in FIG. 3, diesel fuel was utilized and the float valve 68 was adjusted vertically to produce an initial fuel level in the vertical vaporization tube 84 on the order of ¼ inch above the superheater plate 100. Initial combustion then was initiated utilizing two heat-generating trioxane tablets, which are of a known type, as a start-up fuel. During the test run, a thermocouple (not shown) also was attached to the coupler 82 to measure the temperature of the coupler.

As is indicated on the graph of FIG. 3, at 8 minutes elapsed time, a yellow flame was observed in the burner 94, indicating that fuel vaporization had started because trioxane burns with a blue fame. At 9 minutes elapsed time, the heating device 62 made the transition to begin operation on vaporized fuel. After 15 minutes, it was observed that the voltage output of the thermoelectric converter module 116 was in excess of 7 volts, whereupon the float valve 68 was lowered 1 inch, resulting in an essentially immediate decrease in the output voltage. At 16 minutes of operation, the float valve 68 was raised ½ inch, resulting in an immediate increase in the output voltage. Subsequently, at 18 minutes elapsed time, the output voltage had risen to a value of 7.42 volts, whereupon the float valve 68 was lowered ½ inch and the voltage immediately decreased. Subsequently, the voltage, after a slight rise to a maximum of 7.656 volts at 23 minutes, began to progressively decrease to a value of 6.8 volts at 68 minutes. The voltage then stayed relatively constant at a value above 6.7 volts for up to 178 minutes elapsed time, and at 223 minutes had decreased to a value on the order of 6.6 volts, at which time the heating device 62 was shut down. During the run, it was found that the temperature at the coupler 82 reached a maximum of 551° F. at 31 minutes elapsed time, and remained steady at 540° F.±5° between 38 minutes and 223 minutes.

Thus, from the graph of FIG. 3, it is seen that the output of the thermoelectric converter module 116, and thus of the heating device 62, responded rapidly to changes in the vertical height of the float valve 68, and the resultant change in the hydraulic head H and the amount of the liquid fuel F fed to the vaporization tube 84. Further, after the heating device 62 had become stabilized at 6.8 volts at 68 minutes elapsed time, for the next 155 minutes, to 223 minutes elapsed time, the voltage remained relatively constant, dropping only 0.2 of a volt to 6.6 volts, for a change in voltage output on the order of 2.9%. In addition, after no additional changes were made in the height of the float valve 68, the coupler temperature remained relatively constant, indicating a uniform fuel burn rate.

Figure 4:
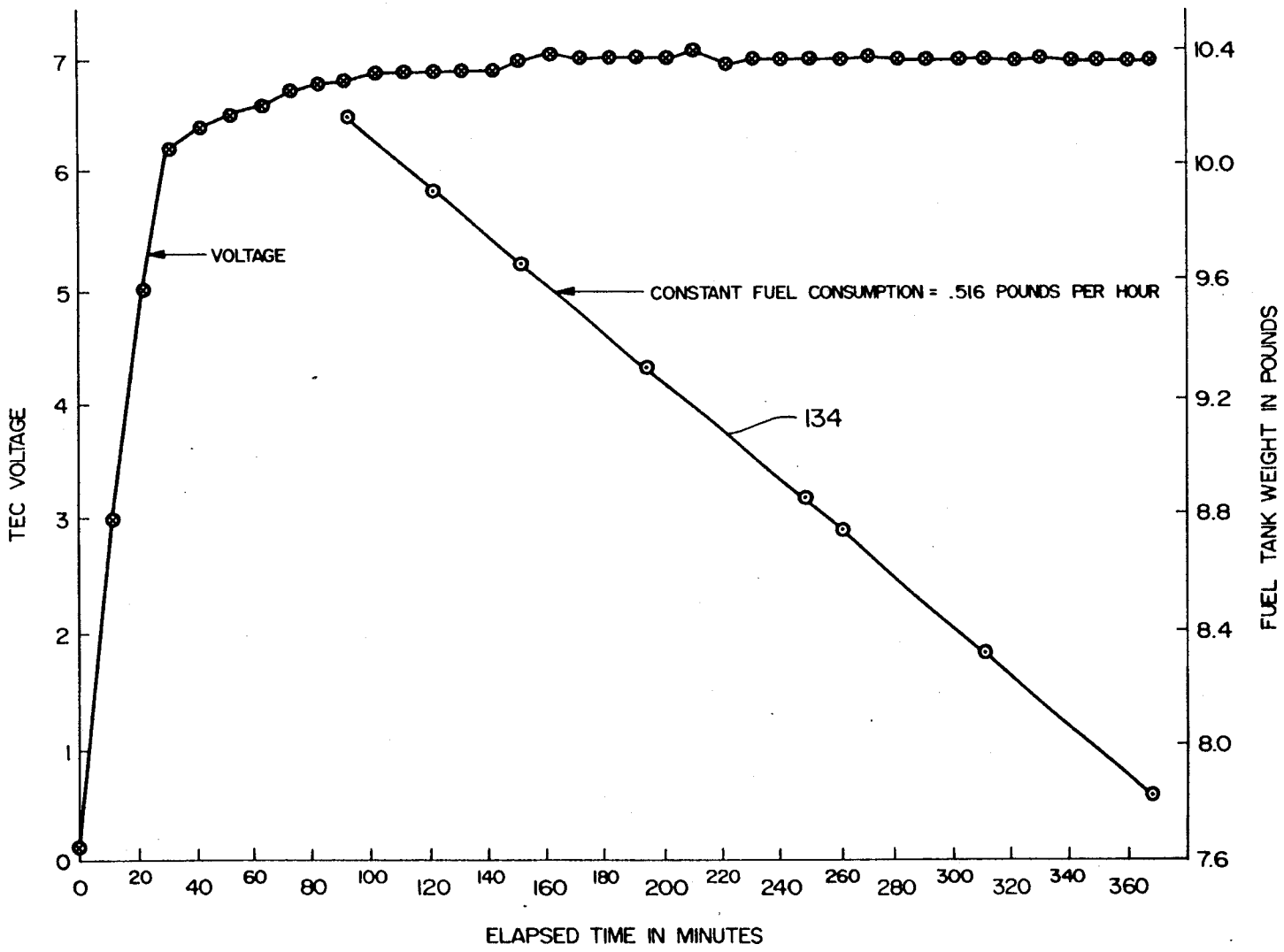
FIG. 4 is a graph further illustrating uniformity characteristics of the liquid fuel flow control system of the invention, based on the voltage output of the thermoelectric converter module shown in FIG. 2, and fuel consumption.

The graph of FIG. 4 illustrates the uniformity of fuel flow which can be achieved using the fuel flow control system 60 of the subject invention, based on voltage output of the thermoelectric converter module 116, and fuel consumption, and with a constant height of the float valve 68. In this test run, diesel fuel was again used, the heat exchanger 120 was modified to reduce its heat-exchange capability so that the system 60 would run at a higher fuel flow rate, and the float valve 68 was set to produce a fuel level in the vertical vaporization tube 84 on the order of 1 inch above the superheater plate 100. The fuel tank 64 also was mounted on a scale (not shown) and the weight of the fuel was recorded periodically during the run.

From the graph in FIG. 4, it is seen that the voltage output of the thermoelectric converter module 116 rose rapidly to a value above 6.0 volts at about 30 minutes elapsed time, and then began to stabilize in a range on the order of 6.8 to 7.0 volts. The voltage subsequently remained essentially constant at approximately 7.0 volts for up on the order of to 360 minutes elapsed time, at which the voltage value was about 6.9 volts. At the same time, it is seen that the fuel consumption flow rate, as represented by the essentially straight line 134, remained constant at a value on the order of 0.516 lbs./hr. from about 90 minutes elapsed time to on the order of 360 minutes elapsed time.

In summary, a new and improved fuel control system and method, for controlling fuel flow to a vaporization tube of a heating device, such as the vaporization tube 84 of the heating device 62, has been disclosed. The system and method involve positioning the float valve 68 vertically so that the surface level of the liquid fuel F in the float chamber 70 is at the same vertical height as a preselected intermediate operating level of the liquid fuel F in the vaporization tube 84. When it is desired to increase or decrease the flow of the liquid fuel F to the vaporization tube 84, for a fuel of a different viscosity, or a different temperature operating environment, it is only necessary that the height of the float valve 68 be raised or lowered accordingly, by the screw-jack 86. Raising of the float valve 68 increases the hydraulic head H produced by the liquid fuel F in the float chamber 70 on the liquid fuel F in the vaporization tube 84, to raise the level of the fuel in the tube, thereby increasing the area of the inner tube surface which is wetted by the fuel, and thus increasing the fuel vaporization rate and the heat output of the heating device 62. Conversely, lowering of the float valve 68 causes a corresponding lowering of the level of the liquid fuel F in the vaporization tube 84, to decrease the inner tube surface area which is wetted by the liquid fuel, to decrease the rate of vaporization, with a corresponding decrease in the heat output of the heating device 62. At the same time, since the liquid fuel F is permitted to free-flow from the float valve chamber 70 to the vaporization tube 84, variations in fuel flow as a result of sediment or particles in the fuel, is eliminated. In addition, the thermoelectric converter module 116, which is operated by heat from the combustion chamber 102 and ambient air from the fan 114, respectively, and, in turn, generates electrical power to operate the fan, makes the heating device 62 further self-generating independent of an outside power source.

I claim:

1. A fuel flow control system for a heating device, which comprises:

vertically extending fuel vaporization means for vaporizing liquid fuel into a fuel vapor for use in a combustion chamber of the heating device;

means for applying heat externally to the vertically extending fuel vaporization means and converting the liquid fuel in the vaporization means to the fuel vapor from an upper surface of the liquid fuel;

chamber means for holding a supply of the liquid fuel;

conduit means for connecting the chamber means to a lower portion of the vertically extending liquid fuel vaporization means so that the liquid fuel free-flows through the conduit means to the vaporization means without any significant obstruction or metering; and means for establishing an upper surface level of the liquid fuel in the chamber means and a corresponding liquid fuel hydraulic head in the chamber means, so that the hydraulic head maintains the upper surface level of the liquid fuel in the vertically extending fuel vaporization means essentially at a level corresponding to the level of the fuel in the chamber means, with the unobstructed or unmetered free-flow of the liquid fuel in the chamber means to the vaporization means occurring essentially in response only to the hydraulic head, to produce a desired uniform fuel flow rate to the vaporization means independent of changes in fuel viscosity as a result of a change in fuel type and/or ambient temperature.

2. The fuel flow control system as recited in claim 1, wherein the vaporization means is an elongated vertical tube.

3. The fuel flow control system as recited in claim 1, which further comprises:

means for vertically adjusting the height of the upper surface level of the liquid fuel in the chamber means to vary the liquid fuel hydraulic head produced by the liquid fuel in the chamber means and thereby change the height of the liquid fuel upper surface level in the vertically extending liquid fuel vaporization means a corresponding amount, to vary the fuel flow rate to the vaporization means, the change in height of the surface level of the liquid fuel in the vaporization means changing the surface area of the vaporization means wetted by the liquid fuel to produce a corresponding change in the rate of vaporization by the vaporization means.

4. The fuel flow control system as recited in claim 3, wherein the chamber means is vertically adjustable relative to the vaporization means.

5. The fuel flow control system as recited in claim 1, wherein the means for applying heat externally to the vertically extending fuel vaporization means includes the combustion chamber so that the heating device is self-generating.

6. The fuel flow control system as recited in claim 5, wherein the vaporization means is disposed in the combustion chamber.

7. The fuel flow control system as recited in claim 1, wherein the heating device further comprises:

thermoelectric converter means for producing electrical power, the thermoelectric converter means including a hot junction electrode heated by heat from the combustion chamber.

8. The fuel flow control system as recited in claim 7, wherein the heating device further comprises:

single means for supplying ambient air to the combustion chamber for combustion, and for supplying ambient air to a cold junction electrode of the thermoelectric converter means for cooling of the cold junction electrode.

9. The fuel flow control system as recited in claim 8, wherein the thermoelectric converter means provides electrical power to the ambient air supplying means.

10. The fuel flow control system as recited in claim 9, which further comprises:

means for vertically adjusting the height of the upper surface level of the liquid fuel in the chamber means to vary the liquid fuel hydraulic head produced by the liquid fuel in the chamber means and thereby change the height of the liquid fuel upper surface level in the vertically extending liquid fuel vaporization means a corresponding amount, to vary the fuel flow rate to the vaporization means, the change in height of the surface level of the liquid fuel in the vaporization means changing the surface area of the vaporization means wetted by the liquid fuel to produce a corresponding change in the rate of vaporization by the vaporization means; and wherein the vaporization means is an elongated vertical tube disposed in the combustion chamber and the means for applying heat externally to the vaporization means includes the combustion chamber so that the heating device is self-generating.

11. The fuel flow control system as recited in claim 10, wherein the chamber means is vertically adjustable relative to the vaporization means.

12. A method of controlling the flow of fuel to a heating device, which comprises the steps of:

arranging a body of liquid fuel in a vertically extending position;

heating the body of the liquid fuel to vaporize the fuel from an upper surface thereof and to form a fuel vapor for use in a combustion chamber of the heating device;

producing a hydraulic head of the liquid fuel by arranging a supply of the liquid fuel adjacent the body of the liquid fuel being vaporized, with an upper surface of the supply of the liquid fuel at a vertical level corresponding to a desired upper surface level of the body of the liquid fuel being vaporized;

providing a connecting means, having no liquid fuel metering means, between the supply of the liquid fuel and a lower portion of the body of the liquid fuel; and permitting the liquid fuel to free-flow from the supply of the liquid fuel through the connecting means to the lower portion of the body of the liquid fuel being vaporized without any significant obstruction or metering, so that the unobstructed or unmetered free-flow of the liquid fuel occurs essentially only in response to the hydraulic head of the liquid fuel, to produce a desired uniform fuel flow rate to the body of the liquid fuel being vaporized independent of changes in fuel viscosity as a result of a change in fuel type and/or ambient temperature.

13. The method as recited in claim 12, which comprises the additional step of:

varying the height of the upper surface level of the supply of the liquid fuel to vary the hydraulic head produced by the supply of the liquid fuel and thereby varying the level of the upper surface of the body of liquid fuel being vaporized, to change the amount of the fuel available to be heated and thereby changing the rate of vaporization of the fuel and the rate of flow of the fuel from the supply of the liquid fuel to the body of fuel being vaporized.

14. The method as recited in claim 12, wherein the body of liquid fuel is at least partially heated and vaporized using heat from the combustion chamber of the heating device.

15. The method as recited in claim 12, which comprises the additional step of:

heating a hot junction electrode of a thermoelectric converter with heat from the combustion chamber to produce electrical power.

16. The method as recited in claim 15, which comprises the additional step of:

utilizing a single device to produce ambient air flow to the combustion chamber for combustion and ambient air flow to a cold junction electrode of the thermoelectric converter for cooling.

17. The method as recited in claim 16, which comprises the additional step of:

utilizing the electrical power of the thermoelectric converter to operate the ambient air flow-producing device.

18. The method as recited in claim 17, which comprises the additional step of:

varying the height of the upper surface level of the supply of the liquid fuel to vary the hydraulic head produced by the supply of the liquid fuel and thereby varying the level of the upper surface of the body of liquid fuel being vaporized, to change the amount of the fuel available to be heated and thereby changing the rate of vaporization of the fuel and the rate of flow of the fuel from the supply of the liquid fuel to the body of fuel being vaporized.

* * * * *